United States Patent [19]

Olszewski et al.

[11] 4,135,380

[45] Jan. 23, 1979

[54] METHOD OF AND AN APPARATUS FOR MANUFACTURING ELONGATED CURVED TUBULAR ELEMENTS

[75] Inventors: Egon Olszewski; Eckehard Hanert, both of Bollingen, Fed. Rep. of Germany

[73] Assignee: Benteler-Werke AG, Paderborn, Fed. Rep. of Germany

[21] Appl. No.: 835,533

[22] Filed: Sep. 22, 1977

[30] Foreign Application Priority Data

Sep. 23, 1976 [DE] Fed. Rep. of Germany ..... 2642743
Sep. 30, 1976 [DE] Fed. Rep. of Germany ..... 2644030

[51] Int. Cl.[2] ..... B21D 7/06; B21D 9/00

[52] U.S. Cl. ..... 72/306; 72/323; 72/369; 72/389; 72/466

[58] Field of Search ..... 72/296, 306, 316, 322, 72/323, 369, 370, 478, 351, 398, 466, 389

[56] References Cited

U.S. PATENT DOCUMENTS

| | | | |
|---|---|---|---|
| 1,748,158 | 2/1930 | Walp | 72/466 |
| 2,044,322 | 6/1936 | Oliver et al. | 72/398 |
| 3,000,424 | 9/1961 | Weise | 72/369 |

*Primary Examiner*—Michael J. Keenan
*Attorney, Agent, or Firm*—Michael J. Striker

[57] ABSTRACT

An apparatus for manufacturing elongated curved tubular elements sequentially clamps longitudinally spaced end portions of a straight elongated tubular section, confines a central portion of the tubular section intermediate the clamped end portions between two dies, applies forces to at least one of the dies to displace the same and thus also the central portion of the tubular section in a predetermined direction and to a given extent with respect to the clamped end portions so that substantially S-shaped transitory portions of deformed cross-sectional shapes develop between the clamped end portions and the central portion of the tubular section, and restores the cross-sectional shapes of the transitory portions preparatory to sequential retraction of the dies and unclamping of the end portions of the tubular section by means of at least one mandrel which is introducible into the tubular section through at least one of the end portions thereof for passage into and through at least one of the transitory portions of the tubular section.

27 Claims, 4 Drawing Figures

METHOD OF AND AN APPARATUS FOR MANUFACTURING ELONGATED CURVED TUBULAR ELEMENTS

BACKGROUND OF THE INVENTION

The present invention relates to a method of manufacturing a multiply-bent tubular element, particularly such which has, in its final shape, two coaxial end portions, a central portion which is axially parallel with the end portions, and transitory portions between the end portions and the central portion which have substantially S-shaped configurations. Also, the present invention relates to an apparatus capable of performing the above method. Tubular elements of the above-mentioned type find widespread use in the construction of various apparatus, and more particularly also in the construction of motor vehicles as constituents of the axles of such motor vehicles. Especially when the tubular elements are to be used in the last-mentioned application, they have to satisfy strigent quality requirements with respect to the accurate coaxiality of the end portions, on the one hand, and to the substantial conformity of the cross-sctions of the S-shaped transitory portions to their shapes prior to the deformation of the tubular element, on the other hand. While it is true that successful attempts have already been made to satisfy the above-discussed requirements, such has been achieved only by incurring substantial expenses in terms of time, material, machinery and personnel.

So, for instance, a prevalent practice has heretofore been to manufacture various curved portions of the tubular elements after one another. Under these circumstances, however, there are to be expected errors in angles, abutments, length and twists, caused by the performance of the operating steps, the type of the machinery used for the performance of the operating steps and the degree of skill and education possessed by the operating personnel controlling the progression of the bending operation, having regard for the rebounding effect taking place subsequently to the performance of the bending operations. However, these errors also occur when the bends of the tubular elements are manufactured in a single operation by means of dies which are equipped with appropriately curved surfaces. In order to be able to eliminate the above-discussed errors, resort must be had to correspondingly constructed arrangements to be operated by especially trained personnel familiar with the operation of such arrangement, in addition to the bending operations and equipment.

Furthermore, it has been heretofore necessary to calibrate the bent tubular elements after the elimination of the above-mentioned errors at least with respect to the S-shaped transitory portions in order to remove the ovality which develops at such transitory portions due to the bending of the tubular element thereat, so as to restore the original cross-sectional configuration of such transitory portions to the greatest extent possible. Even here, special machinery and operating personnel familiar with the operation of such special machinery are needed. When using this machinery, the operating personnel must be very careful when introducing the curved tubular elements from which the above-mentioned errors have already been removed, so as to properly position the tubular element therein. Were it otherwise, that is, were the curved tubular elements improperly introduced into the calibrating machinery, then errors of the above-mentioned type, but especially errors in angle, would again be produced in the improperly positioned curved tubular element. Under these circumstances, such errors, especially the angular errors, would have to be subsequently and additionally corrected at a great expense.

As already mentioned above, the employment of the known methods of manufacturing elongated curved tubular elements of the above-mentioned type by means of pipe-bending machines or by means of deformation by appropriately configurated dies, results in a situation where, for instance, an originally circular cross section of the tubular element is changed to an oval cross section during the bending of the tubular element at least at the S-shaped transitory portions of the tubular element, the ovality being more or less pronounced depending on the circumstances. In some instances, it is necessary, in order to keep the degree of ovality within the limits which are still suited for restoring the original circular cross section by calibration, to make the tubular wall of the tubular element relatively thick. In other words, more material is used for the tubular element than dictated by the consideration of, for instance, stability and strength when the tubular element is to be used as a load-carrying element, such as a motor vehicle axle, or by the resistance to flow when the tubular element is utilized in a fluid-flow circuit of a hydraulic or pneumatic apparatus.

SUMMARY OF THE INVENTION

Accordingly, it is a general object of the present invention to avoid the disadvantages of the prior art.

More particularly, it is an object of the present invention to develop a method of manufacturing a multiply-curved tubular element of the type here under consideration, which is not possessed of the disadvantages of the prior art methods.

Yet more particularly, it is an object of the present invention to so construct an apparatus for performing the above method as to be capable of reducing the time, material, machinery and personnel expenditure encountered in the prior-art apparatus of this type.

A concomitant object of the present invention is to so design the method and the attendant apparatus as to assure a perfect coaxiality of the end portions of the tubular element manufactured thereby, as well as uniformity of the cross-sectional configuration of the tubular element throughout the end portions, transitory portions and the central portion of the latter.

In pursuance of these objects and others which will become apparent hereafter, one feature of the present invention resides, briefly stated, in a method of manufacturing elongated curved tubular elements which comprises the steps of forming a straight elongated tubular section; clamping the tubular section at longitudinally spaced end portions thereof; confining a central portion of the tubular section intermediate the clamped end portions thereof between two dies; applying forces to at least a respective one of the dies to displace the same and thus also the central portion of the tubular section in a predetermined direction and to a given extent with respect to the clamped end portions so that substantially S-shaped transitory portions of deformed cross-sectional shapes develop between the clamped end portions and the central portion of the tubular section; and restoring the cross-sectional shapes of the transitory portions of the tubular section preparatory to sequential retraction of the two dies and unclamping of the end portions of the tubular section, including introducing at least one mandrel into the tubular section through at least one of the end portions thereof for passage into and through at least one of the transitory portions of the tubular section. Preferably, one of the dies is engaged with the central portion first, and the other die is engaged with the central portion opposite to the engagement of the latter by the one die subsequently thereto. In a currently preferred embodiment of the present invention, the two dies are arranged one above the other and move with respect to the clamped tubular element in the vertical direction. It is especially advantageous when the displacement of the central portion during the deformation of the tubular element is performed in the downward direction.

A particularly advantageous aspect of the method of the present invention is to be seen in the fact that the deformation of the originally straight tubular section is accomplished while the central portion of the tubular element is circumferentially completely surrounded by the two dies while the end portions of the tubular element are maintained coaxial with one another by being circumferentially clamped. As a result of this situation, there is obtained the advantage of producing only a small ovality even when a relatively thin-walled tubular section is used, especially at the S-shaped transitory portions. It will be appreciated that it is relatively easy to eliminate such a small ovality. Consequently, there can always be used such tubular sections the thickness of the walls of which is determined based on the stability considerations expected from the finished tubular element. The above-mentioned additional material expenditure only for the purpose of avoiding the development of a too pronounced ovality which can no longer be eliminated, is no longer necessary.

A further advantageous facet of the present invention resides in the fact that the method according to the present invention includes the performance of the calibrating operation, that is, the removal of the ovality which cannot be avoided during the bending of the tubular element and thus the restoration of the original shape especially of the transitory portions, takes place when the deformed tubular element is completely surrounded over its entire circumference at the end portions and at the central portion of the tubular element by the clamping arrangements and by the dies, respectively. Advantageously, two mandrels are introduced into the tubular section, simultaneously from the two ends thereof, and they cause an additional cold deformation following the previously performed bending operation, thus accomplishing an additional hardening of the material of the tubular element. This expedient results in a very advantageous situation in that the rebounding of the material of the tubular element which is always encountered in the methods of the prior art subsequently to the discontinuance of the clamping of the tubular element, no longer exists.

Accordingly, by resorting to the method of the present invention, the bending or deformation of the tubular section, as well as the removal of the ovality which develops during the performance of the bending or deforming operation, especially at the S-shaped transitory portions, are accomplished during a single clamping of the tubular element to be shaped. As a result of this, the heretofore customary sources of errors are eliminated. Thus, for instance, it is no longer possible to improperly position the tubular element after the bending operations and prior to the calibrating operations inasmuch as all of the operations are performed during a single clamping of the tubular element. Also, the angular errors, which have heretofore been considered to be unavoidable, are eliminated by resorting to the present invention. Hence, the curved tubular element has unequivocally coinciding longitudinal axes of the two end portions of the tubular element and unobjectionably constant cross sections over the entire course of the S-shaped transitory portions. The saving of time resulting from the resort to only a single clamping operation is considerable when compared to the previously known methods. Also the saving of expenses otherwise incurred in connection with the required machinery is high inasmuch as, despite the performance of a multitude of operations performed during a single clamping of the tubular element or section, the heretofore additionally required arrangements for the removal of angular, abutment, length and twist errors, as well as for the calibration of the tubular elements, are dispensed with. As far as the saving of personnel is concerned, it is to be mentioned that the persons entrused with the operation of the apparatus for performing the method of the present invention need not have a high degree of skill nor is it necessary to give such persons any special training. This is attributable to the fact that, after the introduction of the straight tubular section into the machine, all further operations are performed in series and automatically and thus need not to be, and will not be, influenced by the operating personnel. Thus, even those errors which are attributable to human errors are avoided.

In order to be able to utilize the effect of the transferal of the counterpressure, which is known from deep drawing, even in the framework of the present invention, an advantageous feature of the method of the present invention resides in the fact that opposing forces are exerted on the respective other die during the time that the displacing forces act on the respective one die to thereby maintain the central portion of the tubular section in confinement between the dies and control the speed and extent of displacement of the respective one die and thus those of the central portion and of the tubular section. Thus, for instance, the upper die is displaced against the lower die which is, for instance, hydraulically pre-tensioned, with attendant full clamping of the respective tubular element or section between the upper and lower dies while the same move in the displacement direction so that the rough curved shape of the curved tubular section is manufactured.

A further advantageous step of the method of the invention resides in the fact that the end portions of the tubular section are clamped with a clamping force which is smaller than the engaging forces with which the two dies act on the central portion of the tubular section. This expedient results in a situation where the end portions of the tubular section are capable of moving in their clamping ones during the deformation of the straight tubular section, without adversely affecting the coaxiality of these two end portions, so that a sufficient amount of the material of the tubular section can be drawn into the S-shaped transitory portions in order to assure uniform cross sections over the entire length of the S-shaped transitory portions of the tubular section.

Another concept of the present invention resides in an apparatus for manufacturing elongated curved tubular elements which comprises means for clamping a straight elongated tubular section at longitudinally spaced end portions thereof; means for confining a central portion of the tubular section intermediate the clamped end portions, including two dies; means for applying forces to at least a respective one of said dies to displace the same and thus also the central portion of the tubular section in a predetermined direction and to a given extent with respect to the clamped end portions so that substantially S-shaped transitory portions of deformed cross-sectional shapes develop between the clamped end portions and the central portion of the tubular section; and means for restoring the cross-sectional shapes of the transitory portions preparatory to sequential retraction of said dies and unclamping of the end portions of the tubular section, including at least one mandrel which is introducible into the tubular section through at least one of the end portions thereof for passage into and through at least one of the transitory portions of the tubular section. Advantageously, each of the dies has a recess which has such a cross-sectional configuration as to substantially conformingly receive a longitudinally extending half of the central portion of the tubular section. Advantageously, the above-mentioned recess of one of the dies has a constant cross-sectional configuration and the recess of the other die has a central region of a constant cross-sectional configuration and two end regions merging with said central region and bounded by a pressure surface which diverges away from the central region. The clamping means advantageously includes two clamping arrangements each including a pair of clamping jaws, each of the clamping jaws of each pair having a clamping recess having such a cross-sectional shape as to substantially conformingly receive a longitudinally extending half of one of the end portions of the tubular section. Advantageously, the clamping recess of one of the jaws of each pair has a constant cross-sectional shape and the clamping recess of the other jaw of the pair has a support surface which diverges toward the other clamping arrangement. Furthermore, the other jaw has an abutment extending into the recess of the other jaw at the end thereof which is remote from the other clamping arrangement and longitudinally delimiting the recess to determine the proper position of the tubular section therein. It is currently preferred that one of the jaws of each pair be stationary while the other jaw is movable toward and away from the stationary jaw.

In a currently preferred embodiment of the present invention, the restoring means includes means for mounting the mandrel on one of the jaws, preferably on the stationary jaw, for displacement relative thereto only into, through and out of the tubular section. Such mounting means advantageously includes a guide block attached to the above-mentioned one jaw and having a guiding recess therein which is in registry with the clamping recess of the one jaw.

When one of the jaws of each pair is stationary as discussed above, there is obtained an unobjectionable unproblematical introduction of the tubular section which is originally straight into the apparatus, with the two dies being retracted into their original positions and the movable jaws of the two pairs being in their inoperative positions spaced from the stationary jaws. The profiling or recessing of the various components of the apparatus avoids all problems which have previously resulted from improperly introducing the tubular section into the deforming machine, and thus also the production faults resulting therefrom. As a result of the clamping of the end portions of the tubular element, which is achieved by lowering the movable jaws of the two jaw arrangements, the end portions of the tubular element are contacted by the jaws over their entire circumference so that the tubular section is held in its proper manufacturing position determined by the stationary and movable profiled jaws. The lower die is displaced until it abuts the straight central portion of the tubular element only after the jaw pairs have arrested the tubular element in its proper working position so that thereafter the straight tubular element is engaged by the lower die over almost its entire length. Only after this is accomplished, the upper die is lowered until it contacts the outer surface of the central portion of the tubular section, whereafter it is further displaced, together with the lower die, to displace the central portion of the tubular element downwardly while the end portions are maintained by the jaw pairs in their original coaxial position, whereby the originally straight tubular element is deformed to assume its rough final configuration. During this deformation, the tubular element is embraced substantially over its entire length at the circumference thereof by the jaws and the upper end lower dies. As a result of this, the development of ovalities or other deformation, especially at the S-shaped transitory regions which are formed between the central portion and the end portions of the tubular element during the deformation of the latter, is limited to an unavoidable minimum degree.

After the upper and lower dies have concluded their deforming displacement, the all-side clamping of the now deformed tubular section is maintained further. This means that the still coinciding longitudinal axes of the end portions of the tubular element are also coaxial with the longitudinal axes of the housing-shaped guide blocks which accommodate the guide the two mandrels, one at each pair of the jaws. The guide blocks can either be components of the stationary profiled jaws, or be rigidly but detachably attached thereto. The coincidence of the longitudinal axes of the guiding recesses and of the clamping recesses for the end portions of the tubular section assures that the calibration which is performed subsequently to the deformation of the tubular element is significantly facilitated. The mandrels are directly transferred out of their housing-shaped guide blocks, without any change in the position of the axis thereof, into the end portions of the tubular element, being further pressed into the S-shaped transitory portions where they then remove the ovality or other deformation which has developed during the deformation of the originally straight tubular section. As a result of the simultaneous pressing of the mandrels into both of the end portions of the tubular element, the material of the tubular element is once more cold-deformed and thus hardened. Thus, it is assured that, after the removal of the mandrels and their retraction into the housing-shaped guide blocks, as well as after the following discontinuance of the clamping of the tubular element by the action of the profiled jaws and by the upper and lower die, no rebound affect can take place in the material of the tubular element due to the otherwise present springiness thereof. Thus, the angular position of the S-shaped transitory portions with respect to the end portions and to the central portion of the tubular element remains unequivocally defined. Resulting herefrom, there is assured the coaxiality of the end portions of the tubular element and the axial parallelism of the central portion of the tubular element with respect to the end portions. The S-shaped transitory portions exhibit a constant cross-sectional configuration over their entire lengths, which largely approximates the cross-sectional shape of the remaining portions of the tubular element.

According to a currently preferred aspect of the present invention, the stationary profiled jaws are provided, at the mutually opposed end regions thereof, with abutments for the end faces of the tubular element, and are provided with convexly curved support surfaces at the regions of their ends which are closer to one another, while the movable profiled jaws have a straight stepless profile. The profiling, that is, the respective clamping recesses, can extend over exactly a half of the circumference of the respective end portion of the tubular element, both in the stationary and in the movable jaw. The abutments in the stationary profiled jaws additionally assure the unobjectionable and proper introduction and positioning of the originally straight tubular section to be deformed. The convexly curved support surfaces at the mutually facing end regions of the stationary profiled jaws have such a curvature that they correspond to the desired curvature between the end portions of the tubular section and the central zones of the S-shaped transitory portions in the final state of the curved tubular element. In addition thereto, the present invention provides for the profile of the upper die which is straight in the central region of the recess to merge into S-shaped diverging pressure zones bounded by pressure surfaces, while the recess in the lower die has a straight and stepless profile over its entire length. As a result of this, there is achieved that the upper and lower jaws, in cooperation with the profiled jaws, embrace the entire deformed tubular element after the termination of the deformation operation, arresting the deformed tubular element in this deformed position. As a result of the configuration of the support surfaces of the stationary profiled jaws in cooperation with the S-shaped receding pressure surfaces of the upper die, precisely the S-shaped transitory regions between the coaxially arranged end portions and the central portion of the tubular element which is offset from but axially parallel to the end portions, are shaped in such a manner that the ovality which results from the deformation of the tubular section is limited to a minimum degree.

The straight-line movements of the movable profiled jaws, as well as those of the upper and lower dies can be accomplished in different conventional ways, such as electrically or pneumatically. However, it is proposed according to a currently preferred concept of the present invention to displace the movable profiled jaws and the dies by hydraulically operated, especially controllable, cylinder-and-piston units or motors.

When the tubular section to be deformed has a circular cross section, then the present invention proposes, according to an advantageous feature thereof, that the mandrels each consist of a plurality of spherical calibrating elements of gradually increasing dimensions and conforming to the shape to be restored, and means for yieldably interconnecting the calibrating elements in series with one another. Furthermore, the mandrel may include a plurality of spacers interposed between the individual spherical calibrating elements, the spacers being formed with two part-spherical depressions each of which partially accommodates one of the spherical calibrating elements. The mandrel may be displaced by a hydraulic drive means, such as by a thrust-piston unit. By way of an example, there may be provided four of the spherical calibrating elements which are so stepped in diameters that, during the pressing of the mandrels into the somewhat oval S-shaped transitory portions of the tubular section, resulting from the deformation of the tubular element, each of the spherical calibrating elements need only perform a strictly limited restoring deformation in direction toward the original circular cross section. After the passage of the last one of the spherical calibrating elements which corresponds in its diameter to the desired inner cross section of the S-shaped transitory portion, a hardening of the material of the tubular section has been achieved by the action of the mandrels thereof so that, subsequent to the retraction of the mandrels from the end portions of the tubular section, and subsequently to the discontinuance of the clamping of the tubular section by the profiled jaws and the dies, the tubular element no longer has any tendency to spring back. Thus, the coaxiality of the end portions of the tubular element is assured hereby. Instead of the mandrels each having four spherical calibrating elements, there could, of course, be also used mandrels having a greater or a smaller number of the spherical calibrating elements.

When the tubular section being deformed has a polygonal cross section, such as a rectangular or a hexagonal cross section, then the present invention proposes to configurate the calibrating elements as rollers which have different orientations in conformity with the shape to be restored. Here again, the individual rollers, which are spaced axially from one another, are connected by yieldable interconnecting elements and are reciprocated, preferably by a hydraulically energized cylinder-and-piston unit. The length of the rollers or the width of their working surface is coordinated with the length of the inner cross-sectional edge of the profile of the tubular element, the angular displacement of the individual rollers with respect to one another in the circumferential direction being determined by the cross-section of the tubular element being, for instance, equal to 90° when the tubular element is rectangular or square in cross section, or being 120° when the tubular element is hexagonal in cross section.

The tubular section which are to be deformed or being deformed by resorting to the arrangement of the present invention, whether they are round or hexagonal in cross section, can be made of a seamlessly extruded tubular material or of welded tubular material.

In order to relieve the personnel entrusted with the performance of the deformation and of the calibration during a single clamping operation, of the direct responsibility for the quality of the work of the machine, a further advantageous aspect of the present invention resides in the fact that the hydraulically operated driving means for the movable profiled jaws, for the dies and for the mandrels are operated in a predetermined sequence by conventional controlling and regulating elements. Thus, the operating personnel has no opportunity to interfere with the series of operations which follows the initial introduction of the straight tubular section into the machine and following the commencement of the deformation thereof. This brings about a considerable advantage that, even if a large series of tubular elements is being produced, there are always obtained workpieces which, with respect to their contours and dimensions correspond to the immediately preceding and also the immediately succeeding tubular elements.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DISCUSSION OF THE PREFERRED EMBODIMENT

Figure 1:
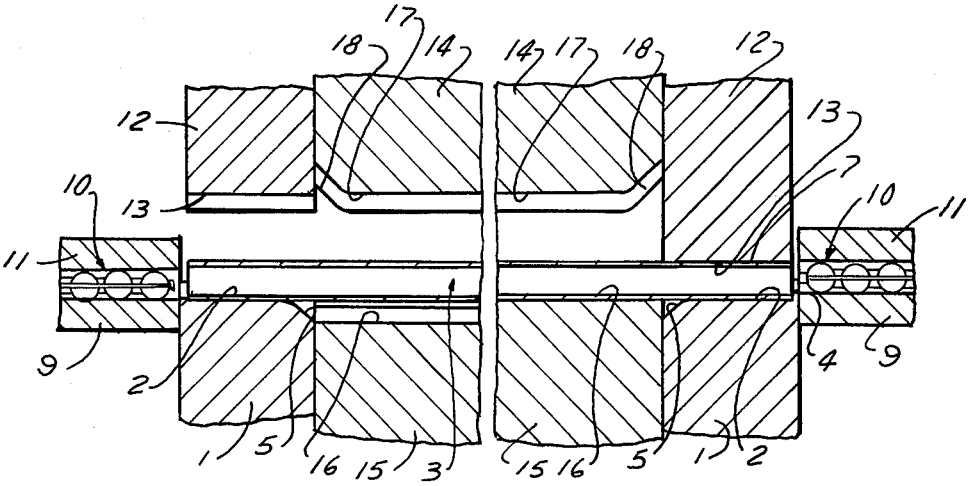
FIG. 1 is a somewhat diagrammatic vertical sectional view of a working area of the bending and calibrating apparatus of the present invention with an inserted straight tubular section to be deformed, in the left half with the movable components of the apparatus in their initial position, and in the right half with a movable jaw and a lower die already engaging the tubular section.

Referring now to the drawing in detail, it may be seen therein that the reference numeral 1 has been used to designate two stationary profiled jaws which may be, for instance, parts of a non-illustrated machine base. The stationary profiled jaws 1 have at their upper part a clamping recess 2 which is half-circular in vertical cross section, which is substantially complementary to one-half of the circumference or cross section of a straight tubular section 3 which has a circular cross section. The tubular section 3 is introduced in the clamping recesses 2 of the stationary profiled jaws 1 and secured in its longitudinal direction by abutments 4 associated with the profiled jaws 1, against axial displacement. The abutments 4 extend as projections from the bottom of the recesses 2 and thus constitute annular regions which have a height at most corresponding to the radius of the straight tubular section 3.

Figure 3:
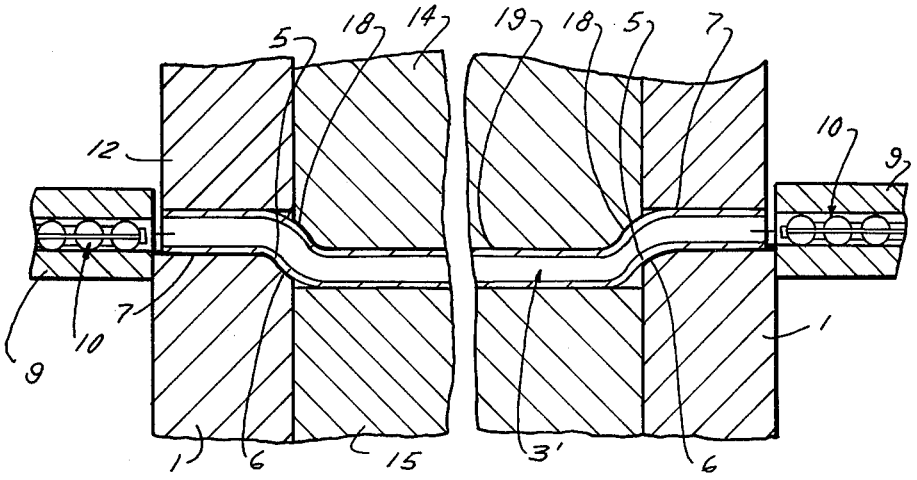
FIG. 3 is a view similar to FIGS. 1 and 2 but showing the situation after the termination of the deforming operation.

At the mutually facing end regions of the recesses 2, the semi-circular profile steplessly merges into convexly shaped support surfaces 5. The curve of the support surfaces 5 corresponds to the bent portion 6 of a deformed transitory portion 3' of the tubular element 3 which is shown in FIG. 3 and which extends between coaxially registering end portions 7 of the tubular section 3 and central regions of the neighboring S-shaped transitory portions 8.

Outwardly on the stationary profiled jaws 1, there are provided guide housings or blocks 9 for mandrels 10, which will be discussed in more detail later on in connection with FIG. 4. The guiding blocks 9 can be components or portions of the stationary profiled jaws 1, but they could even be provided as separate elements attached in a dismountable fashion to the respective stationary profiled jaws 1. The guide blocks 9 are provided with guiding recesses or channels 11 of circular cross sections, the guiding channels 11 being in an axial registry with one another as well as with the longitudinal axes of the semi-circular recesses 2 provided in the stationary profiled jaws 1.

As can be further ascertained from the drawings in general, vertically movable profiled jaws 12 are arranged upwardly of the stationary profiled jaws 1, the movable jaws 12 being connected to non-illustrated conventional hydraulic cylinder-and-piston units for displacement therewith. The axial dimension of the movable profiled jaws 12 corresponds to the axial dimension of the stationary profiled jaws 1, less the thickness of the terminal abutments 4. The end faces of the movable profiled jaws 12 which face the stationary profiled jaws 1 are provided with clamping recesses 13 which are also semicircular corresponding to the outer contour of the tubular section 3 inserted into and supported on the stationary profiled jaws 1. However, this clamping recess 13 of each of the movable profiled jaws 12 extends in a stepless manner over the entire axial length of the respective movable profiled jaw 12.

An upper die 14 and a lower die 15 are arranged between the stationary profiled jaws 1 and the movable profiled jaws 12, respectively, being mounted in correspondingly configurated guides, which have not been illustrated in the drawing inasmuch as they are conventional, for movement along a vertical plane. The upper die 14 and the lower die 15 are set in motion by conventional drives such as, for instance, by hydraulically operated cylinder-and-piston units which also have been omitted from the drawing because of their conventionality.

It may be ascertained from the drawing that the lower die 15 is provided, at its major surface which faces the straight tubular section 3, with a semi-circular recess 16 extending over the entire axial length of the lower die 15 and being complementary to the contour of the straight tubular section 3 over a half of the circumferential dimension or, in other words, a half of the cross section, of the straight tubular section 3.

On the other hand, the upper die 14 is also provided with a recess 17 of the same configuration as discussed immediately above, but only in a central region thereof, while the upper die 14 is provided with pressure surfaces 18 merging with the recess 17 at the ends thereof which are juxtaposed with the movable profiled jaws 12 and which recede, in a S-shaped fashion, from the semi-circular recess 17. The pressure surfaces 18 also bound semi-circular bottom zones which have such a configuration as to correspond in shape possessed by the fully deformed tubular section 3' (compare FIG. 3) at the S-shaped transitory portion 8 at the upper side thereof between the central portion 19 and the end portions 7 of the tubular section 3'.

Having so discussed the construction of the apparatus of the present invention in its basic structure, the operation of such apparatus will now be discussed in some detail, reference being had to the different views of the various figures.

The sequence of operations during which the straight tubular section 3 is deformed into a final curved tubular element 3' commences in the manner illustrated in the left half of FIG. 1 where the straight tubular section 3 is merely inserted into the stationary profiled jaws 1 to be supported thereon. The movable profiled jaws 12 as well as the upper die 14 the lower die 15 are located, in this initial position, at a distance from the tubular section 3.

As can be ascertained from the right half of FIG. 1, the next step in the sequence of operation resulting in the deformation of the tubular section 3 is the movement of the movable profiled jaws 12 toward the tubular section 3 until these profiled jaws 12 contact the surfaces of the end portions 7 of the tubular section 3 so that the stationary profiled jaws 1 together with the movable profiled jaws 12 in their extended positions fully embrace the respective end portions 7 of the tubular section 3 over their respective entire circumferences. After the clamping of the end portions 7 of the tubular element 3 by the profiled jaws 1 and 12, the lower die 15 is displaced until it contacts the central portion of the still straight tubular section 3 so that, from now on, the straight tubular section 3 rests, almost over its entire length, in a semi-circular recess consisting of the clamping recesses 2 of the stationary profiled jaws 1 and the recesses 16 of the lower die 15. The upper die 14 still remains in its initial position and also the mandrels 10 are still accommodated in the guide housing or blocks 9.

Figure 2:
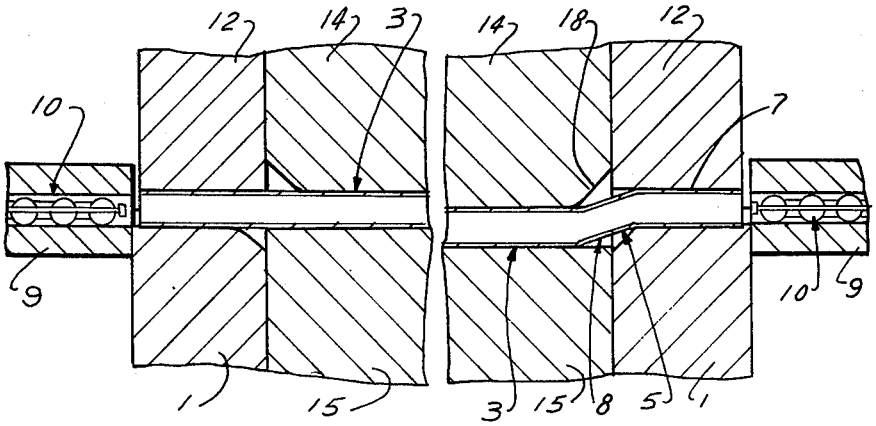
FIG. 2 is a view similar to FIG. 1 but illustrated in the left half the upper die already in contact with the tubular section, and in the right half with the apparatus during the deformation of the tubular element.

As illustrated in FIG. 2, left half, the next step in the deforming operation involves the lowering of the upper die 14 until it contacts the surface of the still straight tubular section 3. After that, the tubular section 3 is circumferentially embraced by the profiled jaws 1 and 12 as well as by the upper and lower jaws 14 and 15. The mandrels 10 are still retracted in their respective guide blocks 9.

The right half of FIG. 2 illustrates a situation which arises during the performance of the deforming operation, wherein the dies 14 and 15 have already performed a part of the deforming operation on the respective tubular section 3. It may be seen from this illustration that the support surfaces 5 of the stationary profiled jaws 1, on the one hand, and the S-shaped receding pressure surfaces 18 of the upper die 14, on the other hand, have already commenced the performance of their function which is to define the S-shaped transitory portions 8 of the tubular section 3. The clamping force between the upper die 14 and the lower die 15 exceeds the clamping force between the movable profiled jaws 12 and the stationary profiled jaws 1. In this manner, the material of the tubular section 3 can be drawn, after overcoming a defined resistance, from the clamping zones at which the end portions 7 of the tubular element 3 are clamped between the profiled jaws 1 and 12, and into the S-shaped transitory portions 8, as can be easily ascertained from the comparison of the right half of FIG. 2 with the FIG. 3. In the illustration of the right side of FIG. 2, the mandrels 10 are still maintained in their retracted positions within the guide blocks 9. It is still to be mentioned that the joint downward movement of the upper die 14 and of the lower die 15 is accomplished while the lower die 15 is pre-tensioned to partially counteract and/or resist the downwardly oriented forces acting on the upper die 14.

FIG. 3 illustrates the situation which arises after the originally straight tubular section 3 illustrated in FIGS. 1 and 2, left half, is deformed to constitute the curved tubular element 3'. It is evident from this figure that even the curved tubular element 3' is further confined between the profiled jaws 1 and 12, as well as between the upper die 14 and the lower die 15, over its entire length and over its entire circumference. The support surfaces 5 of the stationary profiled jaws 1 are located downwardly at the region of transition from the end portions 7 to the S-shaped transitory portions 8, while the pressure surfaces 18 of the upper die 14 are located upwardly at the transition of the central portion 19 into the S-shaped transitory regions 8. However, the mandrels 10 are still maintained within their guide blocks 9. Furthermore, it can be recognized from the illustration of FIG. 3 that, owing to the deformation of the tubular section 3 into the tubular element 3', the material of the tubular section 3 has been partially drawn, based on the definitely predetermined slippage between the same and the movable and stationary clamping jaws 12 and 1, out of the clamping zones defined by the latter and into the S-shaped transitory portions 8.

Figure 4:
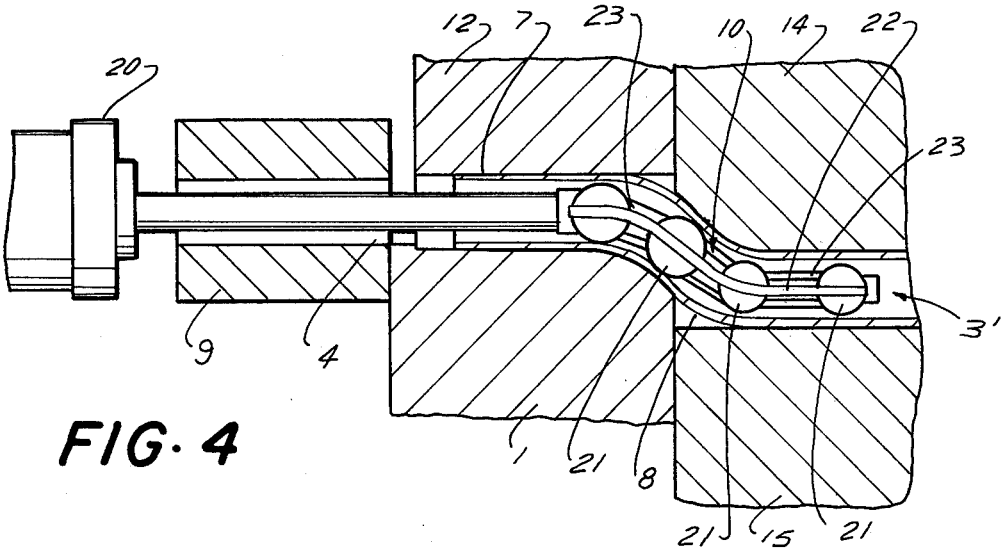
FIG. 4 is an enlarged view of a detail of the apparatus of FIGS. 1 through 3 illustrating a mandrel introduced into the deformed tubular section.

When the manufacture of the curved tubular element 3' in its rough state is completed, that is, when the tubular element 3' has assumed the position illustrated in FIG. 3, the mandrels 10, as illustrated in detail in FIG. 4, are simultaneously extended out of the guide blocks 9 and introduced from both longitudinal sides into the end portions 7 of the tubular element 3', by activating respective cylinder-and-piston units 20. As can be further seen in FIG. 4, each of the mandrels 10 includes four spherical calibrating elements 21 which gradually increase in diameter, the calibrating element 21 having the smallest diameter being located at the leading end of the mandrel 10. The calibrating elements 21 are connected with one another by means of a flexible coupling arrangement 22, such as, for instance, a steel cable. The axial distance of the spherical calibrating elements 21 from one another is determined by annular spacers 23 which are provided, at both axial major surfaces thereof, with part-spherical depressions which are conformed in shape to the cooperating surfaces of the juxtaposed spherical calibrating elements 21.

The mandrels 10 are pressed into the S-shaped transitory portions 8 and largely restore the original round cross section of these portions 8, which has been previously temporarily deformed to an oval shape during the deformation of the straight tubular section 3 into the curved tubular element 3'. Simultaneously therewith, the material of the tubular element 3' is hardened as the circular cross section of the transitory portions 8 is being restored so that, when the clamping of the curved tubular element 3' is discontinued, that is, after the retraction of the mandrels 10 into the guide blocks 9 and after the retraction of the dies 14 and 15 and of the movable profiled jaws 12 into their initial positions illustrated in the left half of FIG. 1, the fully curved tubular element 3' which is now only supported on the stationary profiled jaws 1 at its end portions 7 can no longer spring back. Thus, the coaxiality of the end portions 7 of the tubular element 3' with respect to one another and the axial parallelism of the central portion 19 with respect to the end portions 7 of the tubular element 3' are hereby faultlessly assured.

It will be understood that each of the elements described above, or two or more together, may also find a useful application in other types of constructions differing from the types described above.

While the invention has been illustrated and described as embodied in a method of and an apparatus for manufacturing circular cross-section curved tubular elements, it is not intended to be limited to the details shown, since various modifications and structural changes may be made without departing in any way from the spirit of the present invention. So, for instance, the initial blank or tubular section 3' could be of any other than circular cross section, such as polygonal, and in that event the mandrel 10 would be equipped with rollers contacting the various sides of the polygonal outline, instead of the spherical calibrating elements 21.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

We claim:

1. A method of manufacturing elongated curved tubular elements, comprising the steps of forming a straight elongated tubular section; clamping the tubular section at longitudinally spaced end portions thereof; confining a central portion of the tubular section intermediate the clamped end portions thereof between two dies; applying forces to at least a respective one of the dies to displace the same and thus also the central portion of the tubular section in a predetermined direction and to a given extent with respect to the clamped end portions so that substantially S-shaped transitory portions of deformed cross-sectional shapes develop between the clamped end portions and the central portion of the tubular section; and restoring the cross-sectional shapes of the transitory portions of the tubular section preparatory to sequential retraction of the two dies and unclamping of the end portions of the tubular sections, including introducing at least one mandrel into the tubular section through at least one of the end portions thereof for passage into and through at least one of the transitory portions of the tubular section.

2. A method as defined in claim 1, wherein said confining step includes first engaging one of the dies with the central portion, and subsequently engaging the other die with the central portion opposite to the engagement of the latter by the one die.

3. A method as defined in claim 2, wherein said applying step includes subjecting the respective die to vertically oriented forces; and wherein said confining step includes locating the respective die at a different vertical level than the associated other die.

4. A method as defined in claim 2, wherein said confining step includes locating the other die vertically downwardly from the one die; and wherein said applying step includes subjecting the one die to vertically downwardly oriented forces.

5. A method as defined in claim 1; and further comprising the step of exerting opposing forces on the respective other die during said applying step to thereby maintain the central portion of the tubular section in confinement between the dies and control the speed and extent of displacement of the respective one die and thus those of the central portion of the tubular section.

6. A method as defined in claim 1, wherein said confining and applying steps result in engagement forces between the dies and the central portion of the tubular section; and wherein said clamping step includes subjecting the end portions of the tubular section to clamping forces which are lower than the engagement forces.

7. An apparatus for manufacturing elongated curved tubular elements, comprising means for clamping a straight elongated tubular section at longitudinally spaced end portions thereof; means for confining a central portion of the tubular section intermediate the clamped end portions, including two dies; means for applying forces to at least a respective one of said dies to displace the same and thus also the central portion of the tubular section in a predetermined direction and to a given extent with respect to the clamped end portions so that substantially S-shaped transitory portions of deformed cross-sectional shapes develop between the clamped end portions and the central portion of the tubular section; and means for restoring the cross-sectional shapes of the transitory portions preparatory to sequential retraction of said dies and unclamping of the end portions of the tubular section, including at least one mandrel which is introducible into the tubular section through at least one of the end portions thereof for passage into and through at least one of the transitory portions of the tubular section.

8. An apparatus as defined in claim 7, wherein said applying means includes means for first engaging one of said dies with the central portion, and means for subsequently engaging the other of said dies with the central portion opposite to the engagement of the latter by said one die.

9. An apparatus as defined in claim 8, wherein said direction is vertical; and wherein said respective die is located at a different vertical level than the associated other die.

10. An apparatus as defined in claim 8, wherein said direction is vertical; and wherein said other die is located downwardly from said one die.

11. An apparatus as defined in claim 7, wherein each of said dies has a recess having such a cross-sectional configuration as to substantially conformingly receive a longitudinally extending half of the central portion of the tubular section.

12. An apparatus as defined in claim 11, wherein said recess of one of said dies has a constant cross-sectional configuration; and wherein said recess of the other die has a central region of a constant cross-sectional configuration and two end regions merging with said central region and bounded by a pressure surface which diverges away from said central region.

13. An apparatus as defined in claim 7, wherein said clamping means includes two clamping arrangements each including a pair of clamping jaws; and wherein each of said clamping jaws of each pair has a clamping recess having such a cross-sectional shape as to substantially conformingly receive a longitudinally extending half of one of the end portions of the tubular section.

14. An apparatus as defined in claim 13, wherein said clamping recess of one of said jaws of each pair has a constant cross-sectional shape; and wherein said clamping recess of the other jaw of said pair has a support surface which diverges toward the other clamping arrangement.

15. An apparatus as defined in claim 14, wherein said other jaw has an abutment extending into said recess of said other jaw at the end thereof which is remote from said other clamping arrangement and longitudinally delimiting said recess to determine the proper position of the tubular section.

16. An apparatus as defined in claim 13, wherein one of said jaws of each pair is stationary while the other jaw is movable toward and away from said stationary jaw.

17. An apparatus as defined in claim 13; wherein said restoring means further includes means for mounting said mandrel on one of said jaws for displacement relative thereto only into, through and out of said tubular section.

18. An apparatus as defined in claim 17, wherein said mounting means includes a guide block attached to said one jaw and having a guiding recess therein which is in registry with said clamping recess of said one jaw.

19. An apparatus as defined in claim 7, wherein said mandrel includes a plurality of calibrating elements of gradually increasing dimensions and conforming to the shape to be restored.

20. An apparatus as defined in claim 19, wherein said mandrel further includes means for yieldably interconnecting said calibrating elements in series with one another.

21. An apparatus as defined in claim 19, wherein said calibrating elements are balls; and wherein said mandrel further includes a plurality of spacers interposed between the individual balls of said mandrel.

22. An apparatus as defined in claim 21, wherein each of said spacers has two part-spherical depressions each partially accommodating one of said balls.

23. An apparatus as defined in claim 19, wherein said calibrating elements are rollers which have different orientations in conformity with the shape to be restored.

24. An apparatus as defined in claim 7, wherein said restoring means further includes means for displacing said mandrel.

25. An apparatus as defined in claim 24, wherein said applying means and said displacing means includes hydraulic drive means.

26. An apparatus as defined in claim 25, wherein said displacing means is a reciprocating cylinder-and-piston unit.

27. An apparatus as defined in claim 7; and further comprising means for controlling the operation of said clamping, confining, applying and restoring means in a predetermined sequence.

* * * * *